US005301425A

United States Patent [19]

Ferraro

[11] Patent Number: 5,301,425

[45] Date of Patent: Apr. 12, 1994

[54] ROTARY POWERED DYNAMIC SHAVING SYSTEM WITH SHAVING AID

[75] Inventor: Frank A. Ferraro, Trumbull, Conn.

[73] Assignee: Warner-Lambert Company, Morris Plains, N.J.

[21] Appl. No.: 971,496

[22] Filed: Nov. 4, 1992

[51] Int. Cl.[5] ..... B26B 19/14

[52] U.S. Cl. ..... 30/42; 30/50

[58] Field of Search ..... 30/43.6, 42, DIG. 2, 30/45, 50, 43.4, 346.5, 346.57

[56] References Cited

U.S. PATENT DOCUMENTS 3,800,417 4/1974 Tietjens ..... 30/43.6
3,913,225 10/1975 Tietjens et al. ..... 30/43.6
4,294,010 10/1987 Chen et al. ..... 30/42
4,807,360 2/1989 Cerier et al. ..... 30/41
4,964,214 10/1990 Welsh et al. ..... 30/41

*Primary Examiner*—Richard K. Seidel
*Assistant Examiner*—Hwei-Siu Payer
*Attorney, Agent, or Firm*—Charles W. Almer, III

[57] ABSTRACT

A rotary powered dynamic shaving system providing multidirectional cutting during shaving. The shaving system includes a disposable head rotatably connected to a handle. This head contains a plurality of blades. Each of the blades is displaceably positioned in the head, thereby providing a degree of "float" to the blade and, in turn, substantially reducing the propensity of the device to nick the skin during shaving.

24 Claims, 5 Drawing Sheets

ROTARY POWERED DYNAMIC SHAVING SYSTEM WITH SHAVING AID

BACKGROUND OF THE INVENTION

The present invention relates to a rotary powered shaving system and, more particularly, to a rotary powered dynamic shaving system providing multidirectional cutting during shaving.

In general, two types of shaving are commonly practiced: dry shaving and wet shaving. Traditionally, electric shavers of either the rotary type or the reciprocating type are used for dry shaving. In this regard, the dry shaver's cutters are separated from the skin and whiskers by a facial guard such that the whiskers are removed by a shearing action. The closeness of such shearing action is generally limited to the thickness of the facial guard.

Typically, the razor units employed for wet-shaving have been manually operated. These wet-shaving razor units have generally been capable of providing closer shaves because the absence of a facial guard permits intimate contact between the blade edge and the hair or whiskers to be shaved. However, the manual stroking operation of the traditional wet-shaving razor unit may present more difficulty in fully shaving whiskers that extend in random direction. Additionally, the manual stroking operation is generally more time-consuming.

A rotatable safety razor that overcomes several of the drawbacks associated with wet-shaving razor units yet, at the same time, maintains the advantages of wet-shaving razor units is disclosed in U.S. Pat. No. 4,294,010. The blades of the '010 device, however, are fixed to the rotatable head, i.e., the blades are not free to float. The '010 device also lacks a guard bar, which assists in guiding the skin to the cutting edge of the blade.

It would therefore be desirable to provide a rotary powered dynamic shaving system providing multidirectional cutting during shaving. Ideally, such a shaving system would include at least one blade displaceably positioned in the rotatable head of the shaving system, thereby providing a degree of "float" to the blade that allows the blade to follow the various contours of the skin and, in turn, substantially reducing the propensity of the device to nick the skin during shaving.

SUMMARY OF THE INVENTION

The present invention, which addresses the needs of the prior art, is a rotary powered shaving system providing multi-directional cutting during shaving. The shaving system includes a handle configured to be grasped by a user. The shaving system also includes a head rotatably connected to the handle. This head includes at least one blade having a cutting edge for shaving. The blade is displaceably positioned in the head such that the blade is free to travel in a direction substantially perpendicular to the head in response to forces encountered during shaving. Finally, the shaving system includes means, which are contained in the handle, for rotating the head. Preferably, the head is removably attached to the handle so that the head can be discarded once the blade has been dulled.

A preferred embodiment of the present invention includes three blades equidistantly arranged around the center of the head. Each of the blades is preferably aligned substantially parallel with a radius of the head. Further, each of the blades is upwardly biased by means of a resilient spring. This preferred embodiment also includes a guard bar displaceably positioned in the head.

In another embodiment of the present invention, the blade is movably supported by a pair of laterally-disposed vertical return springs extending from the head. This embodiment also includes a guard bar which is movably supported by a pair of laterally-disposed vertical return springs extending from the head. Preferably, the laterally-disposed vertical return spring are continuous with such head. In addition, the guard bar is preferably one continuous body of thermoplastic material.

In an additional preferred embodiment, the shaving system includes a head configured to receive at least one insert. This insert contains at least one blade, which is movably supported by a pair of laterally-disposed vertical return springs. In another preferred embodiment, the blade is pivotably positioned in the head such that the blade is free to pivot about an axis substantially parallel to the cutting edge in response to forces encountered during shaving.

As a result of the present invention, the skin is shaved with a rotary powered dynamic system that provides multidirectional cutting. This same shaving system includes at least one blade that is displaceably positioned in the rotatable head such that the blade is free to "float," which allows the blade to follow the contours of the skin and, hence, the propensity of the device to nick the skin during shaving is reduced.

DETAILED DESCRIPTION OF THE INVENTION

Figure 1:
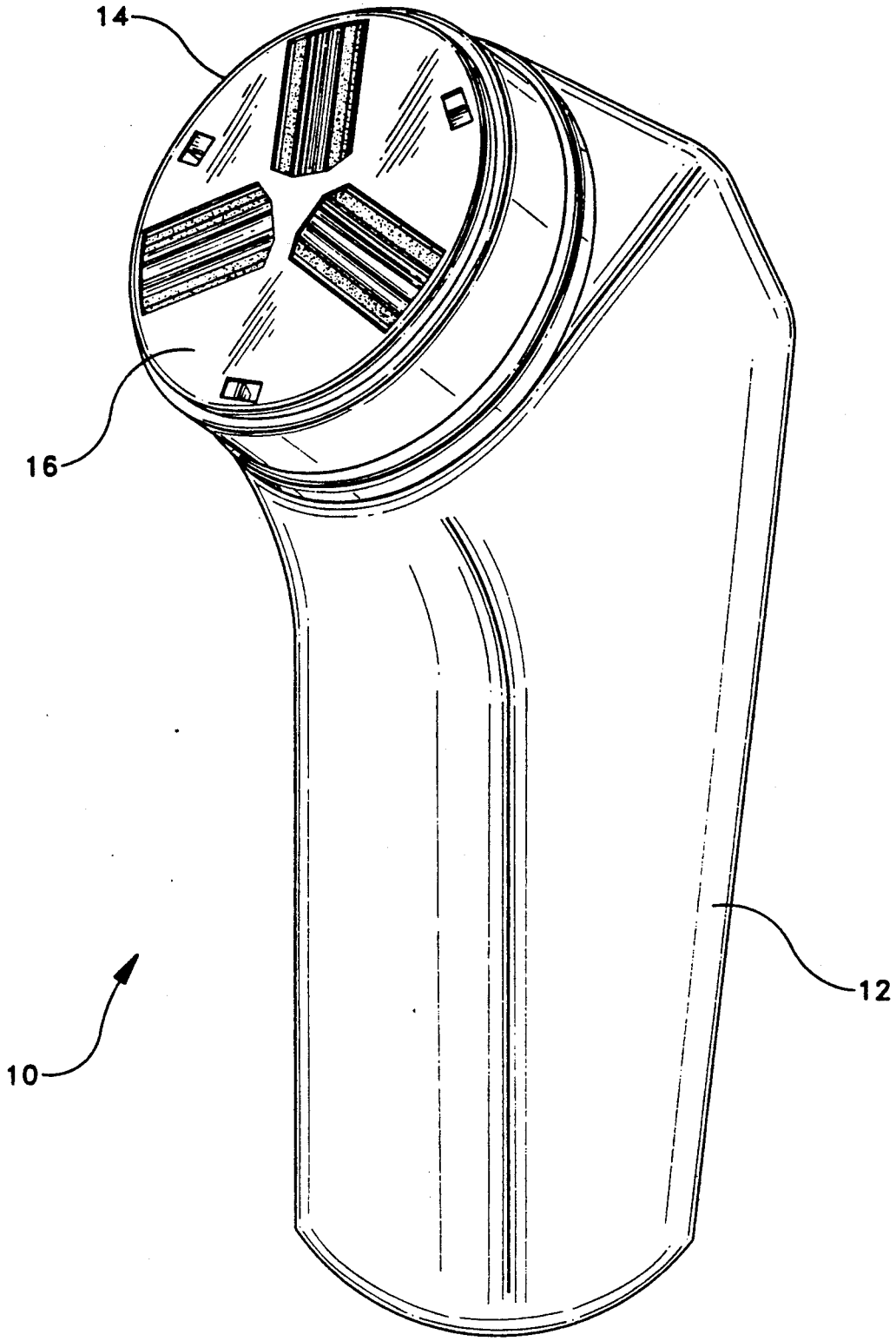
FIG. 1 is a perspective view of the razor unit of the present invention.

Referring to the drawings and, in particular, to FIG. 1, a rotary powered dynamic shaving system 10 is shown. Shaving system 10 includes a handle 12 configured to be readily grasped by a user. The illustrated handle is of an angled design, thereby improving the ease at which a user is able to align head 14 with the surface to be shaved. Of course, handle 12 could also be designed with a substantially linear configuration.

Handle 12 contains a motor (not shown) for rotating head 14. Head 14 may be removed from the handle and discarded once the blades have been dulled. The motor is linked to head 14 through a plurality of movable parts, e.g., gears, shafts, etc. (also not shown). The motor and accompanying movable parts are not important to the present invention and, accordingly, will not be discussed herein. In this regard, a mechanism such as the one disclosed in U.S. Pat. No. 4,294,010, incorporated herein by reference, provides a suitable means for rotating head 14.

Figure 2:
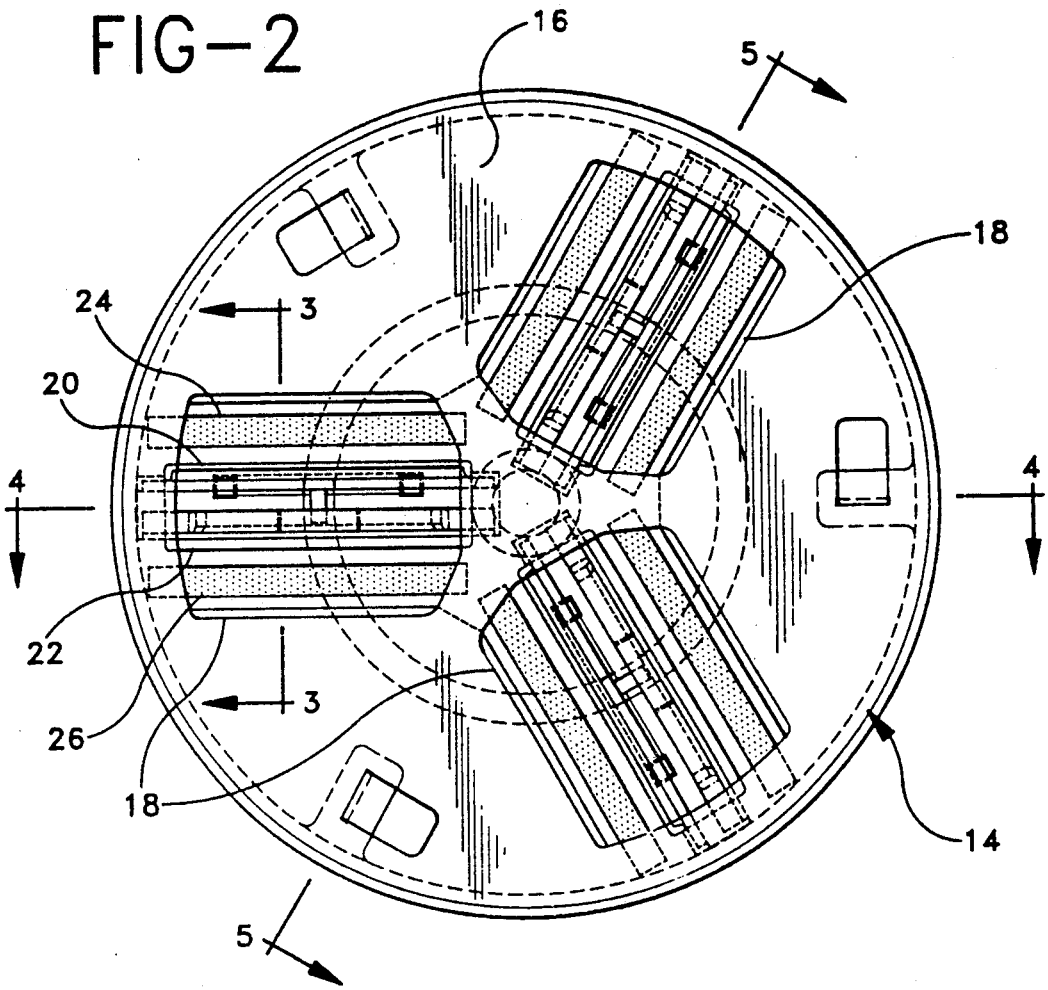
FIG. 2 is a top plan view of the head used in connection with the present invention.

Referring to FIG. 2, head 14 includes a circular plate 16 having three rectangular openings 18 extending therethrough. Positioned underneath each rectangular opening is a blade 20 having a cutting edge for shaving, a guard bar 22 and a pair of shaving aids 24, 26, which may be formed from various polymeric substances known to those skilled in the art.

Figure 3:
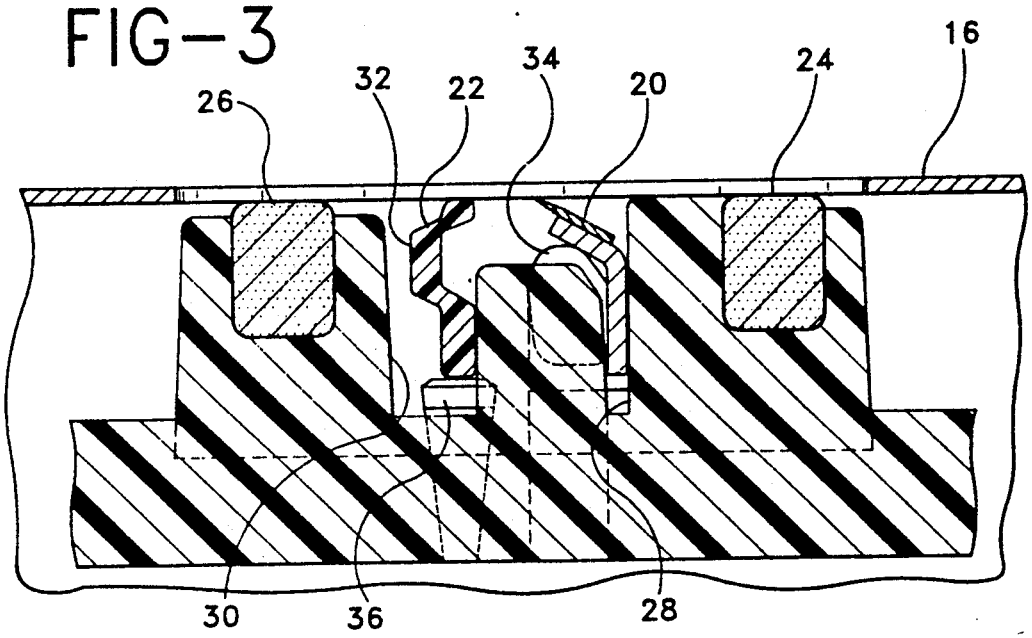
FIG. 3 is a cross-sectional view taken along lines 3—3 of FIG. 2.

Blades 20 have a length approximately equal to one-half the diameter of head 14. Moreover, each of blades 20 is aligned substantially parallel with a radius of head 14. As shown in FIG. 3, each of blades 20 is positioned within a substantially rectangular slot 28. Slot 28 allows for upward and downward movement, i.e., movement in a direction perpendicular to plate 16. Slot 28 may also be configured to allow angular movement of the blade, e.g., slot 28 may be widened in the region nearest plate 16 so that the blade is free to pivot about an axis parallel to the cutting edge of the blade.

Guard bar 22, which is preferably made of a metallic material, is positioned in a substantially rectangular slot 30. Guard bar 22 may include a rib 32 to provide increased rigidity.

Head 14 includes a spring 34 for biasing the blade in an upward direction and a spring 36 for biasing the guard bar in an upward direction. One spring (i.e., either spring 34 or spring 36) is associated with each blade and guard bar.

Figure 4:
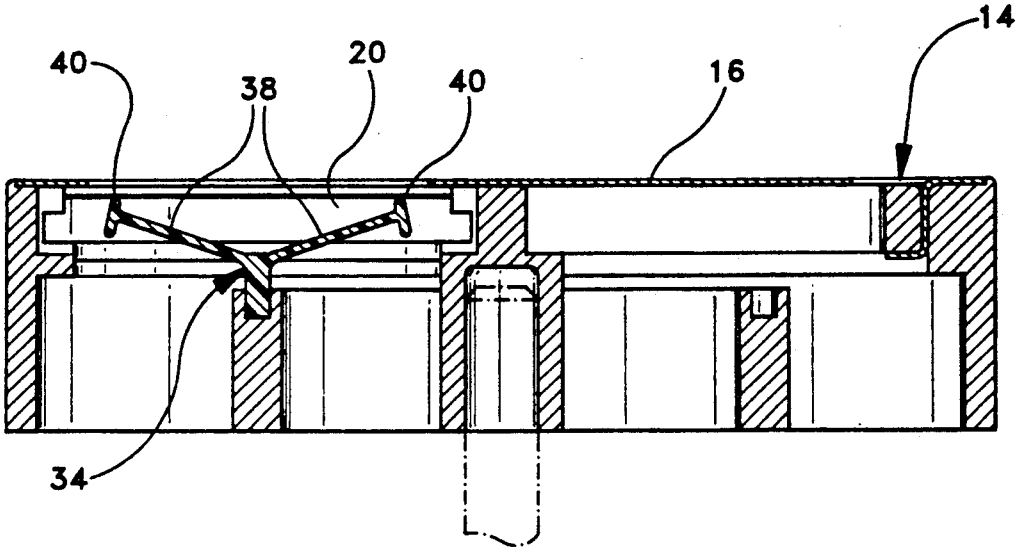
FIG. 4 is a cross-sectional view taken along lines 4—4 of FIG. 2.
Figure 5:
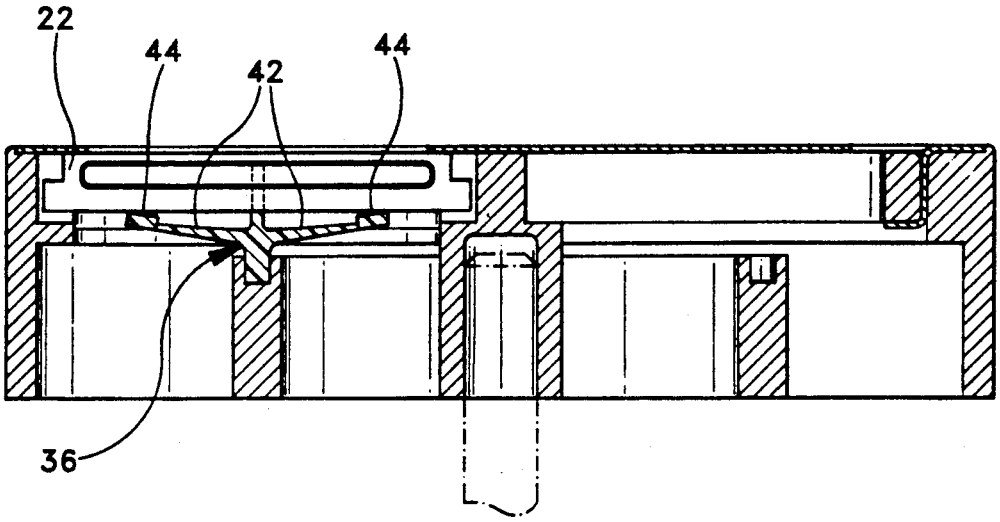
FIG. 5 is a cross-sectional view taken along lines 5—5 of FIG. 2.

Spring 34, which is shown in detail in FIG. 4, is made of a resilient material and includes arms 38 each having support fingers 40. Fingers 40 rest against the underside of the blade (see FIG. 3), thereby urging the blade in an upward direction. Similarly, spring 36, which urges guard bar 22 in an upward direction, includes a pair of arms 42 each having support fingers 44. Of course, other types of spring arrangements could be employed with the present invention. For example, it may be desirable to employ two separate spring members, or even a plurality of spring members, for biasing the blades and/or guard bar.

As shown in FIG. 2, the ends of the blades and of the guard bars extend past openings 18 formed in plate 16. Accordingly, when plate 16 is positioned on head 14, portions of such plate contact the ends of these components, thereby retaining such components in the head. It will be apparent to those skilled in the art that springs 34 and 36 can be designed such that the spring urges the blade (or guard bar) upward against the plate. In other words, by urging the blade upward against the plate, the blade becomes upwardly biased such that the blade, if displaced downward during shaving, will return to its "at-rest" position against the plate after the displacing force is removed from the blade.

During use, head 14 is rotated by the motor/gear arrangement contained within handle 12. As the razor unit is brought into contact with the surface to be shaved, the skin flows into rectangular opening 18, past shaving aid 26, over guard bar 22, and to the cutting edge of blade 20. Following contact with the cutting edge of the blade, the skin flows over the second shaving aid (i.e., shaving aid 24 which, for example, might contain an astringent) and out of the rectangular opening. Because the head is rotating, multidirectional cutting of the surface to be shaved is accomplished as the razor unit is moved across such surface.

Additionally, as the head of the razor unit is moved across the surface to be shaved, both the guard bars and blades are free to travel in a direction perpendicular to plate 16. This type of dynamic blade arrangement provides an ideal system for shaving a contoured surface. In particular, in the present dynamic shaving system, the blades and/or guard bars are free to move in response to forces encountered during shaving, thereby providing the optimum blade geometry for the particular point of the surface being shaved. This, in turn, reduces the likelihood of nicking the skin being shaved.

Figure 6:
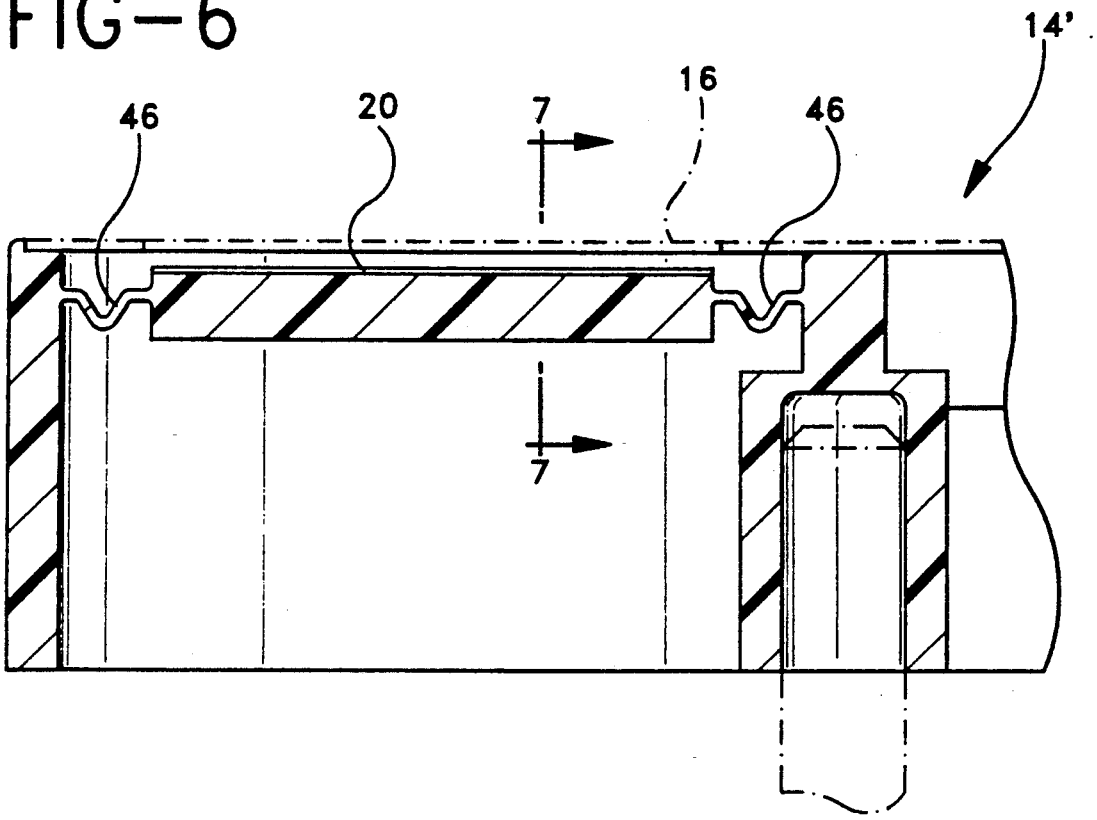
FIG. 6 is a cross-sectional view similar to FIG. 4 showing an alternative embodiment of the present invention.

In a preferred embodiment, the head is integrally formed in an insert molding procedure. Referring to FIG. 6, head 14' is preferably molded without plate 16, such plate being subsequently fitted onto the head. In this illustrated embodiment, the blade (i.e., blade 20') is movably supported on both ends by laterally-disposed vertical return springs 46. Preferably, return springs 46 extend from and are continuous with head 14'. These return springs are configured such that they allow vertical displacement of the blade in response to forces encountered during shaving and return the blade to its original position in the absence of such forces. In other words, return springs 46 operate in the same manner as and function equivalently to spring 34.

Figure 7:
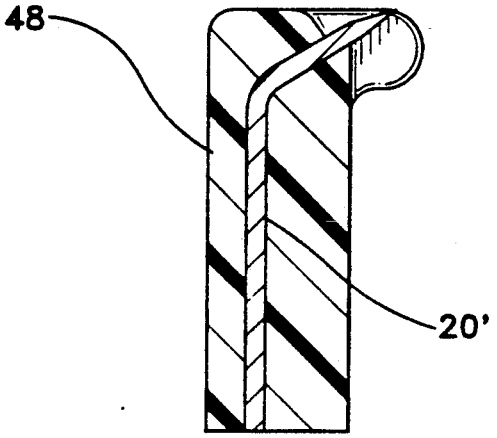
FIG. 7 is a cross-sectional view taken along lines 7—7 of FIG. 6.

As shown in FIG. 7, blade 20' is encased in a rectangular block of thermoplastic material 48. Return springs 46 are continuous with this thermoplastic block and allow such block to move up and down (i.e., in a direction perpendicular to subsequently added plate 16). Alternatively, the embodiment illustrated in FIG. 6 may employ blade 20'', which is shown in detail in FIG. 8.

Figure 8:
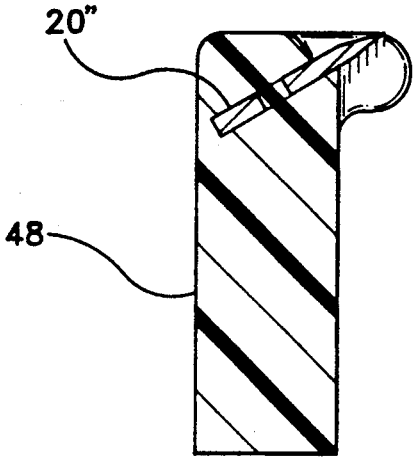
FIG. 8 is a cross-sectional view similar to FIG. 7 showing an alternative embodiment of the present invention.
Figure 9:
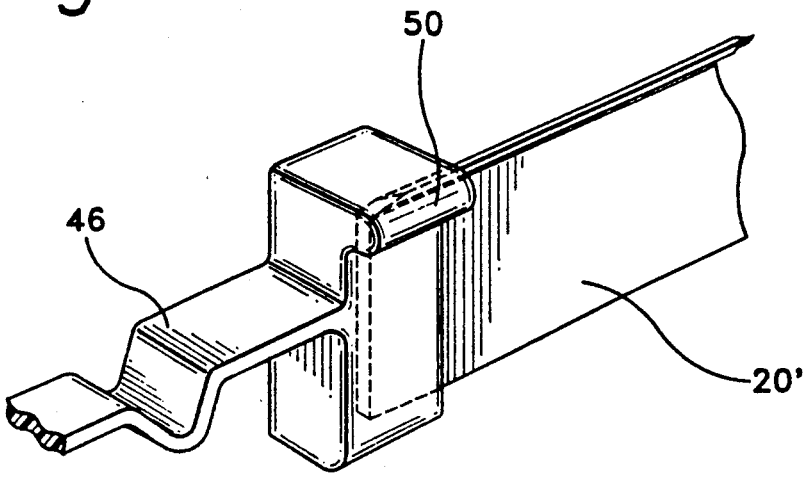
FIG. 9 is an enlarged detail of another alternative embodiment of the present invention.

The blade employed with the embodiment illustrated in FIG. 6 may also be supported as shown in FIG. 9. More specifically, in FIG. 9 blade 20' is encased in thermoplastic material only near its outer ends as compared to having its entire length encased in thermoplastic material as illustrated in FIGS. 6, 7 and 8. This embodiment, along with the others, may include a "bump" of plastic 50 that encases the corner tip of the blade to prevent such tip (which is normally quite sharp) from contacting the user during shaving.

Figure 10:
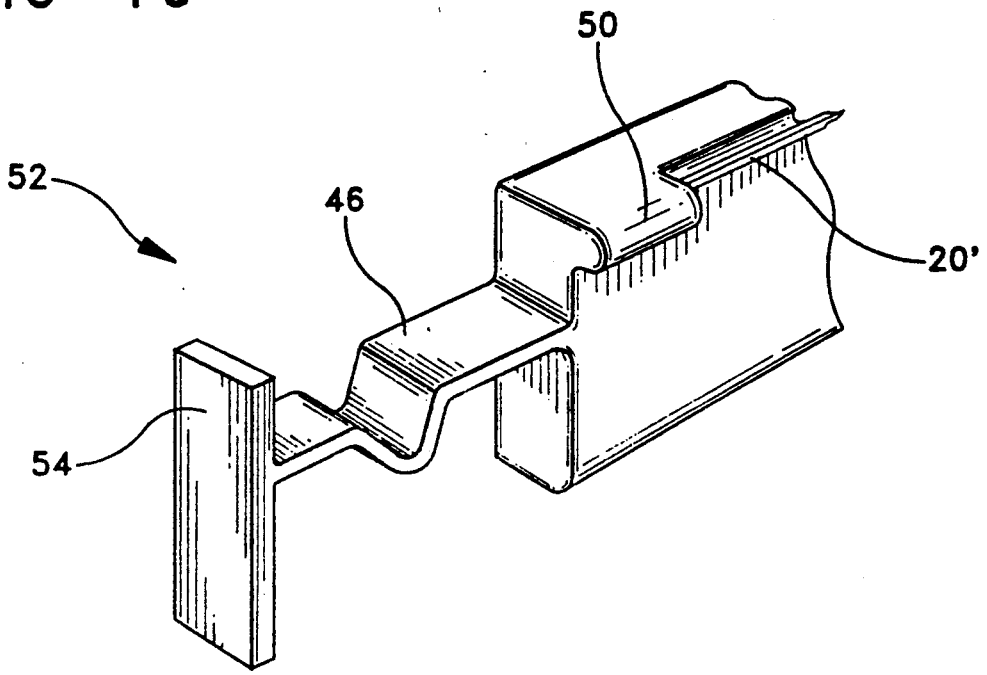
FIG. 10 is an enlarged detail of a further alternative embodiment of the present invention.

Anyone of the embodiments shown in FIGS. 7, 8 and 9 may be molded separately from the head. In such case, the separately molded assembly, i.e., blade insert 52, may be formed with a rail 54 on each of its ends, as illustrated in FIG. 10. Return springs 46 are continuous with rails 54. Once formed, blade insert 52 may be inserted into a previously-formed slot in head 14'.

The blade insert may include more than one component, for example, it may include both a blade and a guard bar, each being displaceably mounted to the insert. In fact, the blade insert may include all three blades and guard bars contained in the preferred embodiment of the present invention. In this case, the blade insert would ideally be circular in design such that it could be inserted into head 14, which is also circular in design.

Although FIGS. 6–10 are directed to the blade disposed in the head, the guard bar may be supported in an identical fashion, that is, a laterally-disposed vertical return spring is formed on each end of the guard bar. In a preferred embodiment, the guard bar is one continuous thermoplastic body that is also continuous with head 14.

While there have been described what are presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed is:

1. A rotary powered dynamic shaving system providing multidirectional cutting during shaving comprising:

a handle configured to be grasped by a user;

a head rotatably connected to said handle, said head including at least one blade having a cutting edge for shaving, said blade movably supported by at least one spring such that said blade is free to travel relative to and in a direction substantially perpendicular to said head in response to forces encountered during shaving.

2. The shaving system according to claim 1, wherein said blade is movably supported by said at least one spring such that said blade is free to travel in an angular direction in response to forces encountered during shaving.

3. The shaving system according to claim 1, wherein said head is removably attached to said handle.

4. The shaving system according to claim 1, wherein said blade is disposed within a substantially rectangular slot.

5. The shaving system according to claim 1, wherein said blade has a length equal to approximately one-half the diameter of said head.

6. The shaving system according to claim 5, wherein said head includes three blades equidistantly arranged around its center.

7. The shaving system according to claim 6, wherein the cutting edge of said blades is aligned substantially parallel with a respective radius of said head.

8. The shaving system according to claim 1, further comprising means for biasing said blade in a upward direction.

9. The shaving system according to claim 8, wherein said means for biasing is a resilient dual-armed spring.

10. The shaving system according to claim 1, further comprising a guard bar displaceably positioned in said head.

11. The shaving system according to claim 10, wherein said guard bar includes a longitudinally extending rib for increased rigidity.

12. The shaving system according to claim 11, wherein said guard bar is disposed within a substantially rectangular slot.

13. The shaving system according to claim 12, further comprising means for biasing said guard bar in an upward direction.

14. The shaving system according to claim 13, wherein said means for biasing is a resilient dual-armed spring.

15. The shaving system according to claim 1, wherein said blade is movably supported by a pair of laterally-disposed vertical return springs extending from said head.

16. The shaving system according to claim 15, wherein said laterally-disposed vertical return springs are continuous with said head.

17. The shaving system according to claim 15, further comprising a guard bar, and wherein said guard bar is movably supported by a pair of laterally-disposed vertical return springs extending from said head.

18. The shaving system according to claim 17, wherein said laterally-disposed vertical springs are continuous with said head.

19. The shaving system according to claim 18, wherein said guard bar is a continuous body of thermoplastic material.

20. The shaving system according to claim 1, further comprising a shaving aid fixed to said head.

21. The shaving system according to claim 20, wherein said shaving aid is mounted proximate said blade.

22. The shaving system according to claim 21, wherein said shaving aid is a polymeric material.

23. A rotary powered dynamic shaving system providing multidirectional cutting during shaving comprising:

a handle configured to be grasped by a user;

a removable head rotatably connected to said handle, said head configured to receive at least one insert, said insert having at least one displaceable blade being movably supported by a pair of laterally-disposed vertical return springs so that said blade is vertically displaceable with respect to said head.

24. A rotary powered dynamic shaving system providing multidirectional cutting during shaving comprising:

a handle configured to be grasped by a user;

a head rotatably connected to said handle, said head including at least one blade having a cutting edge for shaving, said blade movably supported by at least one spring such that said blade is free to pivot relative to said head and about an axis substantially parallel to said cutting edge in response to forces encountered during shaving.

* * * * *